US006059108A

United States Patent [19]

Schiltz, Jr.

[11] Patent Number: 6,059,108

[45] Date of Patent: May 9, 2000

[54] WRENCH ORGANIZER FOR A TOOLBOX

[76] Inventor: Richard Schiltz, Jr., 4223 Rifle Range Rd., Conover, N.C. 28613

[21] Appl. No.: 09/183,103

[22] Filed: Oct. 30, 1998

[51] Int. Cl.[7] ..... B65D 85/28

[52] U.S. Cl. ..... 206/373; 206/376; 211/70.6; 220/23.4

[58] Field of Search ..... 206/372–377, 206/459.5, 561, 509, 349, 499; 211/70.6; 220/4.33, 23.4

[56] References Cited

U.S. PATENT DOCUMENTS

| | | | |
|---|---|---|---|
| 1,816,599 | 7/1931 | Martin . | |
| 2,530,307 | 11/1950 | Leach | 211/70.6 |
| 3,370,696 | 2/1968 | Groe | 206/376 |
| 3,702,136 | 11/1972 | Albertson | 206/376 |
| 3,837,477 | 9/1974 | Boudreau . | |
| 4,621,738 | 11/1986 | DeLucchi | 211/70.6 |
| 4,997,085 | 3/1991 | Brennan . | |
| 5,036,975 | 8/1991 | Chow | 206/373 |
| 5,050,733 | 9/1991 | Brennan . | |
| 5,730,303 | 3/1998 | Chow | 206/376 |
| 5,899,329 | 5/1999 | Hu et al. | 206/376 |

*Primary Examiner*—M. D. Patterson
*Assistant Examiner*—Luan K. Bui
*Attorney, Agent, or Firm*—Andrus, Sceales, Starke & Sawall

[57] ABSTRACT

A tool organizer includes a support base having a vertical wall structure including a pair of opposed end walls and a pair of opposed, parallel sidewalls. The vertical wall is constructed and arranged on the vertical support base to form a tray having a series of tool holding compartments progressively changing in both width and length as viewed from one sidewall to the other sidewall. At least one pair of divider walls is connected together between the end walls and is selectively separable to divide the formed tray into two independent sections. A ridge extends between the sidewalls and is formed with an identifying arrangement to indicate the contents of each compartment.

25 Claims, 3 Drawing Sheets

10
12
14
16
18
20
22
24
26
28
30
32
34
36
38
40
42
44
46
48
50
52
54
55
56
58
60
62
64
66
68
70
72
74
76
78
80
82
84
86
88
90
92
94
96
98
100
102
104
4
5
T1
T2

WRENCH ORGANIZER FOR A TOOLBOX

FIELD OF THE INVENTION

This invention relates generally to the functional organization, storage and use of tools and, more particularly, pertains to the formation of a fixed wall, multi-compartment tray for wrenches and related equipment.

BACKGROUND AND SUMMARY OF THE INVENTION

Mechanics, repairmen, craftsman and other tool users commonly desire that drawers or trays in storage chests, particularly in tool boxes, be subdividable to a series of compartments for organizing and segregating various components therein. This is particularly applicable to various sizes, lengths and types of wrenches required for a specific function. Many systems have been devised for this purpose, including systems using insertible notched strips or a set of dowel inserts held in place between a pair of opposed walls in a drawer. Some of the systems store wrenches in a horizontal fashion which makes it difficult to retrieve certain wrenches as well as to determine the exact size of the horizontally stored wrenches.

It is desirable to provide a uniquely-shaped and sized tool organizer that optimizes storage space efficiency in a standard sized toolbox. It is additionally desirable to provide a commercially attractive tool organizer which is economically manufactured to enable storage of and access to wrenches of a particular size in a graduated manner such that their size and dimensions can be readily ascertained. It is also desirable to provide a tool organizer wherein elongated wrenches are enabled to lay flat and stacked, and are presented preferably in a vertical array. It is further desirable to provide a tool organizer which may be downsized according to the support surface constraints of the tool user.

It is one object of the present invention to provide a tool organizer which is produced to accommodate multiple wrench sets within the same organizing unit. It is also an object of the present invention to provide a tool organizer which requires no assembly of inserts and has no movable parts. It is a further object of the present invention to provide a tool organizer having an indexing system for readily identifying a particular wrench or tool in a particular fixed storage area. Another object of the present invention is to provide a wrench organizer having connected walls which are selectively separable to split or divide the organizer into at least two independent sections. Still another object of the present invention is to provide a tool organizer having a tray which may be subdivided into multiple trapezoidal departments of a progressive size and shape. Yet another object of the present invention is to provide tool organizer which is highly resistant to breakage, corrosion, cracking and peeling.

In one aspect of the invention, a tool organizer includes a support base having vertical wall structure including a pair of opposed end walls and a pair of opposed parallel side walls. The vertical wall structure is constructed and arranged on the support base to form a tray having a series of tool holding compartments progressively changing in both width and length as viewed from one side wall to the other side wall. The vertical wall structure includes a plurality of parallel, spaced apart, stationary interior walls extending upwardly from the support base. Each of the interior walls lies parallel to the side walls and perpendicular to the one of the end walls so as to vertically orient the compartment with respect to the one end wall. The vertical wall structure also includes at least one set of divider walls extending upwardly from the support base and lying between and parallel to one pair of the interior walls. The divider walls are connected together between the end walls, and they are selectively separable to divide the formed tray into two respective independent sections. One of the independent sections has a substantially rectangular periphery, and the other of the independent sections has a substantially trapezoidal periphery. The vertical wall structure further includes a ridge extending between the side walls, which defines one end limit of each compartment and one of the end walls defines another end limit of each compartment. The ridge lies at an angle of less than 90° relative to either of the end walls. The ridge is formed with a set of spaced apart identifiers in the form of circular depressions for indicating the contents of the compartments, there being one identifier for each of the compartments. Each of the compartments has a common depth and is substantially trapezoidally shaped. The vertical wall structure further includes at least one auxiliary interior wall extending between one of the end walls and the ridge for defining at least one pair of auxiliary tool holding compartments. An auxiliary ridge is formed with another set of identifiers for identifying the contents of the auxiliary compartments. In the preferred embodiment, the tray is fabricated from a molded plastic material. Each of the compartments has a substantially constant width throughout its length except for a triangular area nearest the ridge in each compartment.

In another aspect of the invention a wrench organizer for storing elongated wrenches includes a planar support base, a front end wall, a rear end wall spaced from and parallel to the front end wall, a pair of opposed, parallel side walls, a ridge extending between the side walls and lying at an inclined angle relative to the front end wall, and a series of fixed interior walls lying parallel to the side walls and extending upwardly from the support base between the ridge and the front end wall, and the ridge and the rear end wall. The front end wall, the rear end wall, the side walls, the ridge and the interior walls define a tray having a series of variously sized tool holding compartments for holding a plurality of wrenches in a progressively sized manner such that the longitudinal axes of the wrenches lie substantially perpendicularly to the front end wall, and at least a pair of auxiliary compartments for retaining wrench-related equipment therein. The length of the front end wall defines the width of the tray. The rear end wall extends from one of the side walls to the ridge. The wrench organizer includes a pair of connected divider walls extending between the ridge and the front end wall, the dividing walls being unhooked to divide the formed tray into a first section having a substantially rectangular periphery and a second section having a substantially trapezoidal periphery. The first section is bounded by a portion of the front end wall, one of the side walls, the rear end wall and one of the divider walls. The second section is formed of another portion of the front end wall, the other of the divider walls, a portion of the ridge and the other of the side walls. Each tool holding compartment is provided with an identifier for identifying the contents therein.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
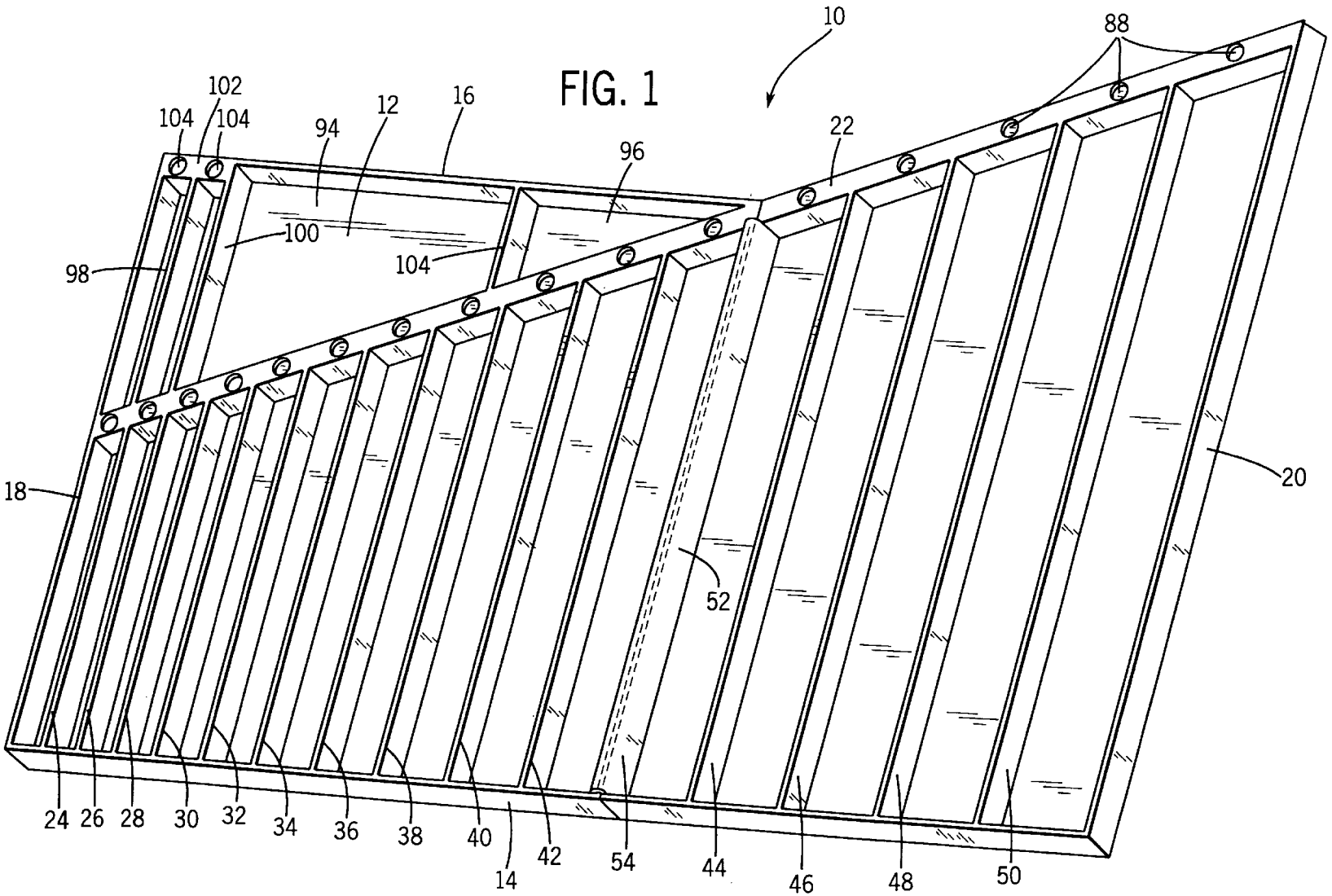
FIG. 1 is a perspective view of a wrench organizer embodying the present invention.

Referring now to the drawings, the tool organizer constructed in accordance with the present invention is embodied in an asymmetrically-configured, polygonal tray 10 which is particularly useful in the storage of variously sized wrenches of the metric or standard type. Tray 10 is formed by a common planar support base 12 having a vertical wall structure including a front end wall 14, a rear end wall 16 and a pair of opposed side walls 18, 20 which are disposed substantially perpendicularly to front end wall 14. Front end wall 14 and side wall 20 have lengths which define the major dimensions of the overall tray 10. In the preferred embodiment, the tray 10 is suitably dimensioned to rest upon a flat support surface in a toolbox with the front end wall 14 facing forwardly therefrom. Although tray 10 has particularly utility in a toolbox, it should be understood that tray 10 may be positioned on any flat support surface and oriented as desired by the user. It should also be understood that the invention is applicable to an organizer specifically constructed and arranged to form a tray having a predetermined storage system corresponding to the sizes of the particular tool set.

A fixed ridge 22 extends from an intermediate point on side wall 18 to a distal or upper end of side wall 20, and lies at an inclined angle, that is less than 90°, relative to either front end wall 14 or rear end wall 16. A plurality of spaced apart, parallel, stationary interior walls 24–50 extend upwardly from the support base 12 in parallel relationship with side walls 18 and 20, and lie substantially perpendicular to front end wall 14. A pair of divider walls 52, 54 (FIG. 4) are located between interior walls 42 and 44, and also project upwardly from the support base 12 with divider wall 54 folded over upon itself at 55 so as to be connected in hooked relationship over divider wall 52 between the front end wall 14 and ridge 22. As will be described hereafter, the connected divider walls 52, 54 are selectively separable when it is desired to split the tray 10 into at least two independent sections. In addition, the joined divider walls 52, 54 lie between and are parallel to the pair of interior walls 42, 44. Divider walls 52,54 are suitably dimensioned so that when they are hooked together, support base 12 and the top surface of ridge 22 lie in parallel planes.

Together, support base 12, front end wall 14, rear end wall 16, side walls 18, 20, ridge 22, interior walls 24–50 and divider walls 52, 54 collectively define a series of primary tool holding compartments 56–86. As will be described below, each primary compartment 56–86 is preformed in size and shape so as to allow for the most efficient storage and retrieval of a set of wrenches having slots and openings of various sizes. In the illustrated embodiment, each primary compartment 56, 58, 60, progressively increases in length while maintaining a substantially constant width. The majority of primary compartments 62–86 gradually increase in both width and length as viewed in the direction of side wall 20. Each of the primary compartments 56–86 is substantially trapezoidally shaped such that for each individual compartment ridge 22 defines an upper limit and front end wall 14 defines a lower limit. In other words, primary compartment 56 is created by vertical wail structure, namely, a segment of front end wall 14, a segment of ridge 22, a segment of side wall 18 extending between front end wall 14 and ridge 22, and interior wall 24. Each primary compartment 58–74 and 80–84 is formed by a segment of front end wall 14, a segment of ridge 22, and a pair of adjacently disposed interior walls 24–42 and 44–50. Each primary compartment 76, 78 is defined by a segment of front end wall 14, a segment of ridge 22, and walls 42, 52 and 44,54, respectively.

In accordance with the invention, primary compartments 56–86 are particularly sized, prearranged and ordered in a vertical array relative to front end wall 14. Such array conveniently accommodates the progressive size of a particular type of wrench set so that the longitudinal axes of the elongate wrenches lie substantially perpendicularly to the front end wall 14. With this arrangement, it has been found desirable to provide primary compartments 56, 58, 60 on the left side of tray 10 with storage spaces having common width and varying lengths for wrenches which are relatively short and have small slots and apertures. It is likewise desirable to provide the majority of primary compartments 62–86 with storage spaces for receiving wrenches which are progressively larger in length and in sizes of the slots and the apertures. Tray 10 is thus preformed to accommodate the gradual increase in a particular type of open (e.g. standard or metric) wrench set.

Figures 3, 5:
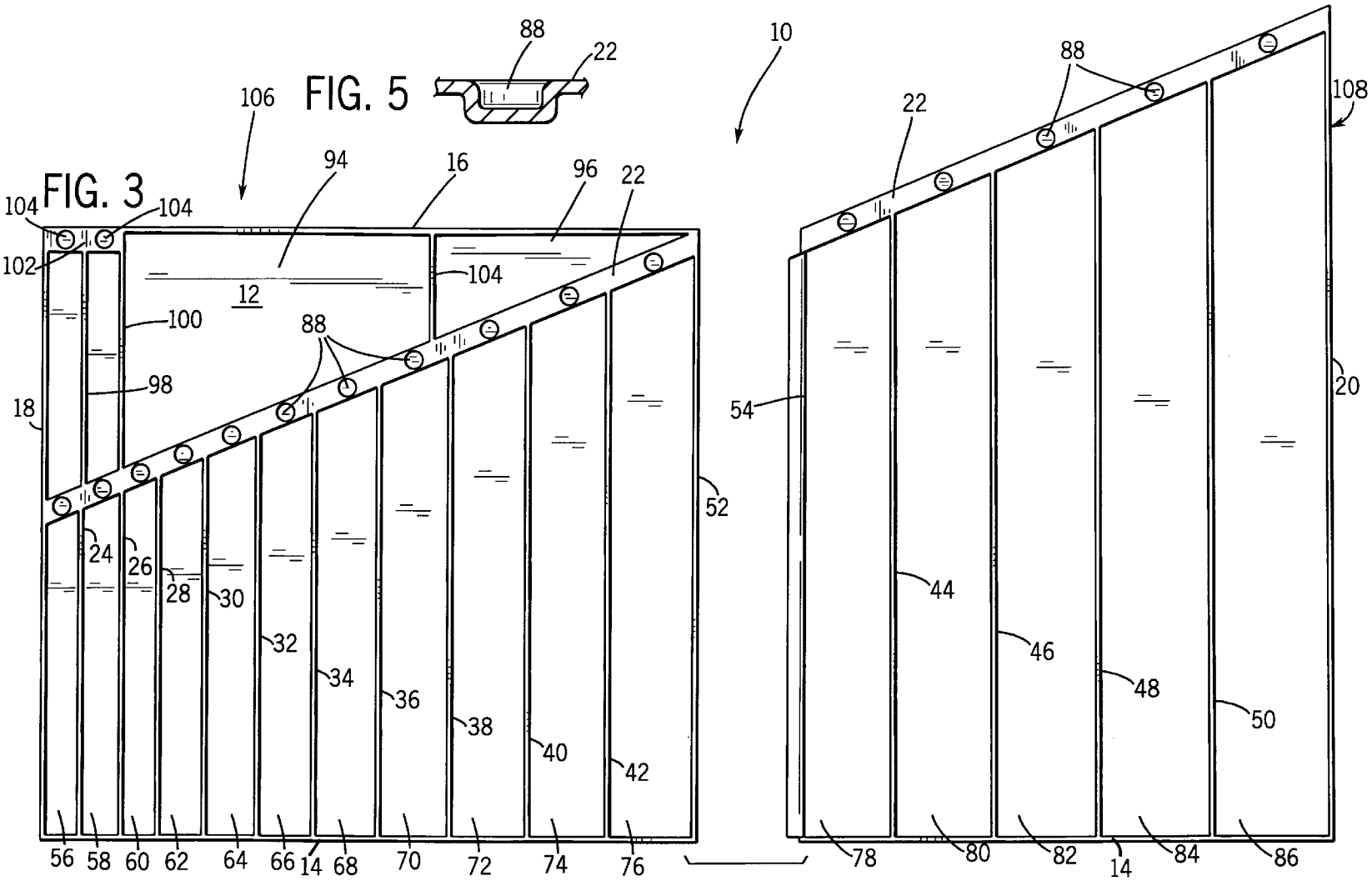
FIG. 3 is an exploded view of the wrench organizer of FIG. 1 split into two independent sections.
FIG. 5 is a partial cross-sectional view taken along line 5—5 of FIG. 2.

In keeping with the predetermined order, an upper surface of ridge 22 is provided with spaced apart identifying means for indicating the contents of each primary compartment 56–86. As seen in FIG. 5, each identifying means is preferably a circular depression 88 identifying the particular size wrench residing in each compartment. Each depression 88 is furnished with a decal (not shown), embossed or otherwise provided with a readily identifiable indicia to describe the wrench lying therein. A typical identifier would describe the length and/or socket size of the wrench in a particular primary compartment.

In addition to the formation of the primary tool holding compartments 56–86, the invention further contemplates the creation of auxiliary tool holding compartments 90,92,94,96 bounded by rear end wall 16, a segment of side wall 18 between rear end wall 16 and ridge 22, and a segment of ridge 22 extending between side wall 18 and divider wall 52. More precisely, a pair of auxiliary stationary interior walls 98,100 are disposed in alignment with interior walls 24,26, respectively, and lie parallel to side wall 18. Auxiliary walls 98,100 extend from ridge 22 to an auxiliary ridge 102 formed at the intersection of rear end wall 16 and side wall 18. Auxiliary tool holding compartment 90 is defined by the segment of side wall 18 between ridge 22 and auxiliary ridge 102, a segment of ridge 22, the auxiliary wall 98 and half of the auxiliary ridge 102. Auxiliary tool holding compartment 92 is formed by auxiliary walls 98,100, a segment of ridge 22, and the other half of auxiliary ridge 102. Both auxiliary compartments 90,92 are trapezoidal in shape and have a shorter length but similar width as compared with aligned primary compartments 56,58. Auxiliary ridge 102 is formed of identifying depressions 104 which are similar to the depressions 88 described with respect to ridge 22. Tray 10 is also formed with an auxiliary interior wall 104 which extends between rear end wall 16 and ridge 22, and lies parallel to auxiliary interior walls 98,100. Auxiliary wall 104, a segment of rear wall 16, auxiliary wall 98 and a segment of ridge 22 define the trapezoidal bounds of auxiliary tool holding compartment 94. Auxiliary wall 104, a segment of rear end wall 16, and a segment of ridge 22 form the triangularly shaped auxiliary tool holding compartment 96. It is envisioned that wrenches having a shorter length than those in primary compartments 56,58 are stored in the auxiliary compartments 90,92. Auxiliary compartments 94,96 are useful in storing wrench related apparatus such as, socket drivers and extensions, marking equipment, measuring devices, nuts and bolts, keys, miscellaneous wrenches and the like.

The depth of tray 10, as well as the thickness of each of the wrenches, will determine if more than one wrench of a particular size can be stored in the organizer. In the preferred embodiment, represented in part by FIG. 4, each primary compartment 56–86 and each auxiliary compartment 90,92, 94,96 has a substantially constant depth measured from the top surface of ridge 22 or the upper end of interior walls 24–50,100,104 and the divider walls 52,54 to the top surface of support base 12. Such construction creates tool holding compartments 56–86 and 90–92, each of which are preformed large enough to accommodate particularly sized wrenches of virtually all wrench manufacturers. Such construction also allows multiple trays to be stacked one upon the other if desired, as long as the tools stacked or otherwise stored in each compartment 56–86 and 90–96 do not protrude above the height of the interior walls.

Figures 2, 4:
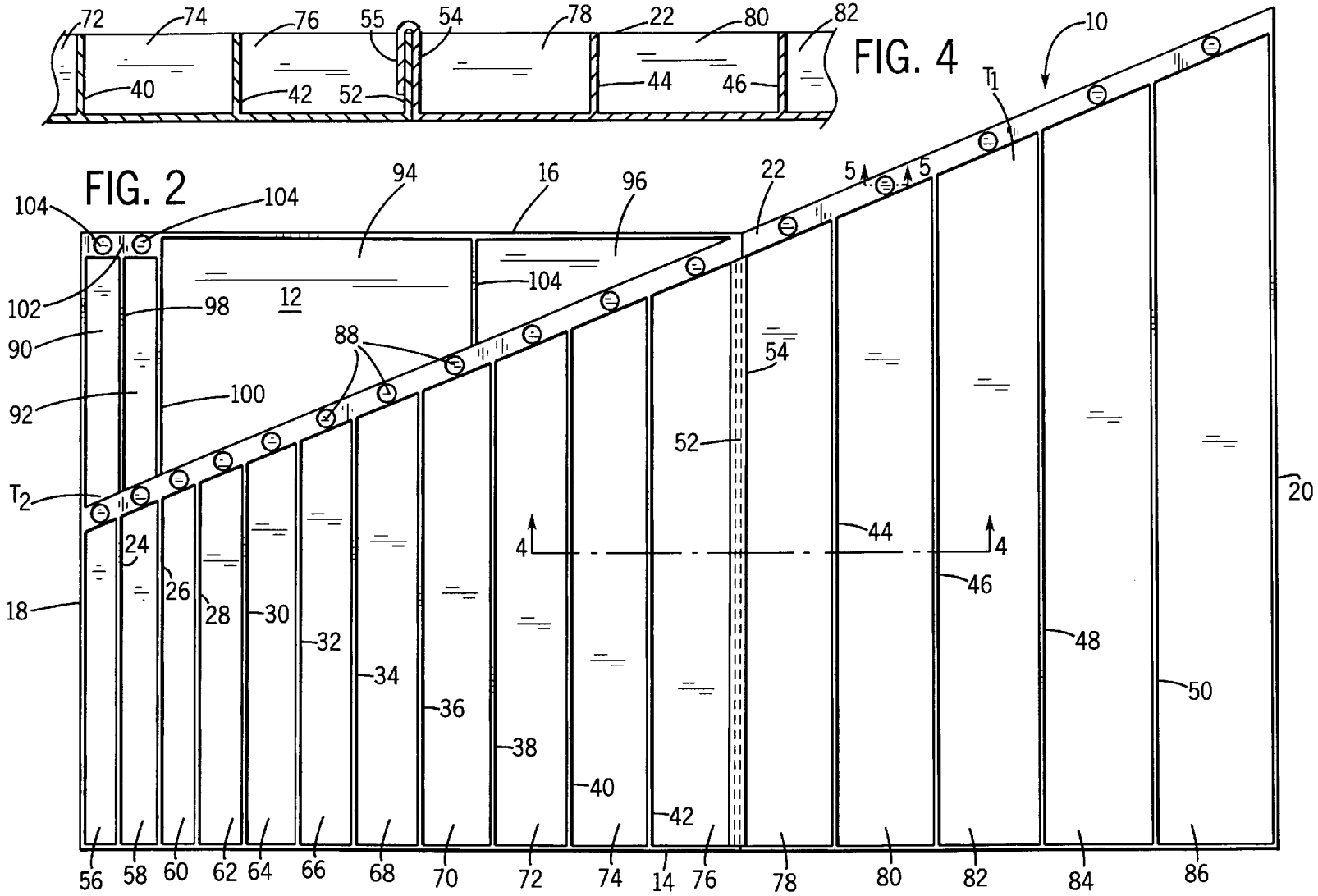
FIG. 2 is a top plan view of the wrench organizer of FIG. 1.
FIG. 4 is a partial cross-sectional view taken along line 4—4 of FIG. 2.

It is important to understand that the design of the tool organizer of the present invention is dependent on the trapezoidal shape of each tool holding compartment 56–86 and 90–92. That is, the width of each tool holding compartment remains substantially constant throughout that compartment to restrain that particular sized tool or tools therein except for a portion of the trapezoid nearest ridge 22 which defines a triangular area in each primary compartment, such as represented by $T_1$ in compartment 82 and $T_2$ in compartment 90 (FIG. 2). Each triangular area allows a tool user easy access and finger manipulation to store or retrieve tools in an ordered, pre-sized fashion corresponding to a particularly sized wrench set.

Tray 10 is preferably molded from thermoplastic material or heavy duty polymer such as polypropylene which exhibits a high strength to weight ratio and provides an economically produced tray 10 which is durable and rustproof. Following the molding process, the divider walls 52,54 are hooked together in a manner such that with a simple unhooking one may selectively split the tray 10 (FIG. 4) into two independent smaller sections 106,108, as shown in FIG. 3. Section 106 has a substantially rectangular periphery bounded by a portion of front end wall 14, side wall 18, rear end wall 16 and divider wall 52. Section 108 has a substantially trapezoidal periphery bounded by another portion of front end wall 14, divider wall 54, a portion of ridge 22 and side wall 20. The divisibility of the organizer is especially useful when dealing with smaller toolboxes or reduced area support surfaces, such as the top of a ladder. When it is desired to restore the tray 10 to its unified form, divider wall 54 is simply placed over divider 52. Divider walls 52,54 may also be constructed for connection by other suitable fastening means, such as adhesive or Velcro materials or any other arrangement which will normally maintain the tray in a unitary assembly but will allow separability as desired.

Alternatively, section 106 can be sold without section 108 to accommodate certain toolbox sizes or wrench sets which do not include the larger wrenches adapted to be received in compartments 78–86 of section 108.

It can thus be appreciated that the invention provides a useful tool organizer having fixed and precise storage compartments oriented in a vertical array for accommodating socket wrenches of a particular type which vary progressively in width and length. Unlike the prior art, there are no dowels or inserts of any kind required. Not only is the organizer manufactured to reflect the sizes of a particular wrench set, but it also includes an identifying arrangement which specifies the exact location for a particular size, such as setting forth a numerical size or length/slot size. Such feature prevents the wrenches or tools from becoming misplaced or lost since one can readily see where a wrench might be missing. It should also be appreciated that the divisibility feature of the organizer enables the tray to be split and downsized when it is desired into at least two independent sections depending on space constraints of the user. The material used in forming the tray provides a strong yet pliable structure which is highly resistant to breakage, corrosion, peeling and cracking.

Various alternatives and embodiments are contemplated as being within the scope of the following claims particularly pointing out and distinctly claiming the subject matter regarded as the invention.

I claim:

1. A tool organizer comprising:

a support base having vertical wall structure including a pair of opposed end walls and a pair of opposed parallel sidewalls, the vertical wall structure constructed and arranged on the support base to form a tray having a series of tool holding compartments progressively changing in both width and length in a direction from one sidewall to the other sidewall;

wherein the vertical wall structure includes a plurality of parallel, spaced apart, stationary interior walls extending upwardly from the support base, each of the interior walls lying parallel to the sidewalls and perpendicular to one of the end walls so as to vertically orient the compartments with respect to the one end wall;

wherein the vertical wall structure also includes at least one pair of divider walls extending upwardly from the support base and lying between and parallel to one pair of the interior walls;

wherein the divider walls are connected together between the end walls, and are selectively separable to divide the formed tray into two respective independent sections.

2. The tool organizer of claim 1, wherein one of the independent sections has a substantially rectangular periphery, and the other of the independent sections has a substantially trapezoidal periphery.

3. The tool organizer of claim 1, wherein the vertical wall structure further includes a ridge extending between the sidewalls, the ridge defining one end limit of each compartment and one of the end walls defining another end limit of each compartment.

4. The tool organizer of claim 3, wherein the ridge lies at an angle of less than 90° relative to either of the end walls.

5. A tool organizer comprising:

a support base having vertical wall structure including a pair of opposed end walls and a pair of opposed parallel sidewalls, the vertical wall structure constructed and arranged on the support base to form a tray having a series of tool holding compartments progressively changing in both width and length in a direction from one sidewall to the other sidewall;

wherein the vertical wall structure further includes a ridge extending between the sidewalls, the ridge defining one end limit of each compartment and one of the end walls defining another end limit of each compartment;

wherein the vertical wall structure farther includes at least one auxiliary interior wall extending between one of the end walls and the ridge for defining at least one pair of auxiliary tool holding compartments.

6. The tool organizer of claim 5, wherein each compartment is substantially trapezoidally-shaped.

7. The tool organizer of claim 5, wherein the ridge is formed with a set of spaced apart identifying means for indicating the contents of the compartments, there being one identifying means for each of the compartments.

8. The tool organizer of claim 7, wherein each identifying means, is a circular depression formed in the ridge.

9. The tool organizer of claim 5, wherein each compartment has a common depth.

10. The tool organizer of claim 5, including an auxiliary ridge formed with another set of identifying means for indicating the contents of the auxiliary compartments.

11. The tool organizer of claim 5, wherein the tray is fabricated from a molded plastic material.

12. The tool organizer of claim 5, wherein each of the compartments has a substantially constant width throughout its length except for a triangular area nearest the ridge in each compartment.

13. A wrench organizer for storing elongated wrenches comprising:

a planar support base;

a front end wall;

a rear end wall spaced from and parallel to the front end wall;

a pair of opposed, parallel sidewalls;

a ridge extending between the sidewalls and lying at an inclined angle relative to the front end wall;

a series of fixed interior walls lying parallel to the sidewalls and extending upwardly from the support base between the ridge and the front end wall, and between the ridge and the rear end wall;

the support base, the front end wall, the rear end wall, the sidewalls, the ridge, and the interior walls defining a tray having a series of variously sized tool-holding compartments for holding a plurality of wrenches in a progressively sized manner such that the longitudinal axes of the wrenches lie substantially perpendicularly to the front end wall, and at least a pair of auxiliary compartments for retaining wrench related equipment therein.

14. The wrench organizer of claim 13, wherein the length of the front end wall defines the width of the tray.

15. The wrench organizer of claim 13, wherein the rear end wall extends from one of the sidewalls to the ridge.

16. The wrench organizer of claim 13, including a pair of hooked divider walls extending between the ridge and the front end wall, the divider walls being unhooked to divide the formed tray into a first section having a substantially rectangular periphery and a second section having a substantially trapezoidal periphery.

17. The wrench organizer of claim 16, wherein the first section is bounded by a portion of the front end wall, one of the sidewalls, the rear end wall and one of the divider walls.

18. The wrench organizer of claim 16, wherein the second section is formed by another portion of the front end wall, the other of the divider walls, a portion of the ridge and the other of the sidewalls.

19. The wrench organizer of claim 13, wherein each of the tool holding compartments are provided with identifying means for identifying the contents thereof.

20. A tool organizer, comprising:

a bottom wall;

a pair of spaced end walls interconnected with the bottom wall and extending upwardly therefrom;

a pair of spaced side walls interconnected with the bottom wall and extending upwardly therefrom and extending between the end walls;

partition structure extending between the pair of sidewalls and operable to define a first section and a second section;

a first series of spaced interior walls extending between the partition structure and a first one of the end walls for dividing the first section into a series of compartments, wherein the partition structure is angled so as to define compartments of varying heights; and one or more second interior walls interconnected between the partition structure and a second one of the end walls for dividing the second section into a series of compartments.

21. The tool organizer of claim 20, wherein the partition structure is arranged such that endmost compartment of the second section has a height slightly less than the endmost compartment of the first section at the same end of the tool organizer.

22. The tool organizer of claim 20, wherein the first interior walls of the first section have a greater spacing toward one end of the first section than toward the other end, for providing an increasing width as the length of the compartments increases due to the angle of the partition structure.

23. A tool organizer, comprising:

a first member having a series of tool-receiving compartments;

a second member having a series of tool-receiving compartments;

releasable engagement structure interposed between the first and second members for selectively engaging the first and second members together and for releasing engagement thereof;

wherein the compartments of the first member increase in size in the direction toward the releasable engagement structure and wherein the compartments of the second member decrease in size toward the releasable engagement structure.

24. The tool organizer of claim 23, wherein the first and second members each include a ridge extending non-parallel to an end wall, and a series of interior walls extending between the ridge and the end wall for dividing each member into the compartments.

25. The tool organizer of claim 24, wherein the compartments of the first member are located on one side of the ridge, and further comprising one or more storage compartments on the opposite side of the ridge.

* * * * *

UNITED STATES PATENT AND TRADEMARK OFFICE

CERTIFICATE OF CORRECTION

PATENT NO. : 6,059,108
DATED : May 9, 2000
INVENTOR(S) : RICHARD SCHILTZ

It is certified that error appears in the above-identified patent and that said Letters Patent is hereby corrected as shown below:

On The Face

[76] Inventor: Delete "Jr."

[56] References Cited: Delete "1,816,599" and substitute therefor -- 1,816,598 --

In The Claims

Claim 1, column 6, line 37, after "walls" insert -- , --; Claim 5, column 7, line 3, delete "farther" and substitute therefor -- further --; Claim 8, column 7, line 14, after "means" delete ",".

Signed and Sealed this

Seventeenth Day of April, 2001

*Attest:*

Nicholas P. Godici

NICHOLAS P. GODICI

*Attesting Officer*

*Acting Director of the United States Patent and Trademark Office*